US012509981B2

(12) United States Patent
Stewart

(10) Patent No.: US 12,509,981 B2
(45) Date of Patent: Dec. 30, 2025

(54) PARAMETRIC ATTRIBUTE OF PORE VOLUME OF SUBSURFACE STRUCTURE FROM STRUCTURAL DEPTH MAP

(71) Applicant: Saudi Arabian Oil Company, Dhahran (SA)

(72) Inventor: Simon A. Stewart, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 312 days.

(21) Appl. No.: 17/941,896

(22) Filed: Sep. 9, 2022

(65) Prior Publication Data

US 2024/0084690 A1 Mar. 14, 2024

(51) Int. Cl.
*E21B 47/003* (2012.01)

(52) U.S. Cl.
CPC ..... *E21B 47/003* (2020.05); *E21B 2200/20* (2020.05)

(58) Field of Classification Search
CPC .... E21B 2200/20; E21B 47/003; E21B 49/00; G01V 20/00
See application file for complete search history.

(56) References Cited

U.S. PATENT DOCUMENTS 4,271,596 A 6/1981 Ganis
5,442,950 A * 8/1995 Unalmiser ..... G01N 15/088 73/152.05
6,147,497 A 11/2000 Berryman et al.
6,446,014 B1 9/2002 Ocondi
6,549,854 B1 4/2003 Malinverno et al.
7,359,844 B2 4/2008 Sung et al.
8,213,261 B2 7/2012 Imhof et al.
8,360,148 B2 1/2013 Atwood et al.
(Continued)

FOREIGN PATENT DOCUMENTS

CN 105089658 4/2018
WO WO 01/42621 6/2001
(Continued)

OTHER PUBLICATIONS

Lemon et al., Building solid models from boreholes and user-defined cross-sections, Computers and Geosciences, 2003 (Year: 2003).*

(Continued)

*Primary Examiner* — Kyle R Quigley
(74) *Attorney, Agent, or Firm* — Fish & Richardson P.C.

(57) ABSTRACT

Example computer-implemented methods, media, and systems for determining a total gross rock volume (GRV) of multiple hydrocarbon reservoir units at a site are disclosed. One example method includes receiving multiple data points with each including an element representing a depth of a location on a structure depth map of a first reservoir unit at a site and another element representing a volume enclosed by the structure depth map and between the location and a closing contour of the first reservoir unit. A function representing a relationship between a GRV of a reservoir unit at the site and a closure height of the reservoir unit is curve fit to the multiple data points. A GRV of each of multiple reservoir units at the site is determined using the function. A total GRV of the multiple reservoir units is determined based on the GRV of each of the multiple reservoir units.

20 Claims, 6 Drawing Sheets

(56) References Cited

U.S. PATENT DOCUMENTS

| | | | | |
|---|---|---|---|---|
| 8,417,497 | B2 | 4/2013 | Osypov et al. | |
| 8,423,337 | B2 | 4/2013 | Hsu et al. | |
| 8,523,487 | B2 | 9/2013 | Georgiou et al. | |
| 8,670,288 | B2 | 3/2014 | Bjerkholt | |
| 8,812,334 | B2 | 8/2014 | Givens et al. | |
| 8,849,640 | B2 | 9/2014 | Holl et al. | |
| 8,892,407 | B2 | 11/2014 | Budiman et al. | |
| 8,908,925 | B2 | 12/2014 | Hurley | |
| 8,931,580 | B2 | 1/2015 | Cheng et al. | |
| 9,008,972 | B2 | 4/2015 | Imhof et al. | |
| 9,022,129 | B2 | 5/2015 | Dobin et al. | |
| 9,134,457 | B2 | 9/2015 | Hurley et al. | |
| 9,593,558 | B2 | 3/2017 | Sequeira, Jr. et al. | |
| 10,013,800 | B1 | 7/2018 | Mallet et al. | |
| 10,323,499 | B2 | 6/2019 | Dykstra et al. | |
| 10,370,955 | B2 | 8/2019 | De Prisco | |
| 10,385,678 | B2 | 8/2019 | Nguyen | |
| 10,822,938 | B2 | 11/2020 | Zhu et al. | |
| 10,914,864 | B2 | 2/2021 | Bratvedt et al. | |
| 10,948,617 | B2 | 3/2021 | Qin et al. | |
| 2003/0018437 | A1 | 1/2003 | Stark | |
| 2003/0046005 | A1 | 3/2003 | Haarstad et al. | |
| 2003/0101033 | A1 | 5/2003 | Torkildsen | |
| 2004/0138818 | A1 | 7/2004 | Shray et al. | |
| 2005/0038604 | A1 | 2/2005 | Marin et al. | |
| 2006/0136162 | A1 | 6/2006 | Hamman et al. | |
| 2008/0033656 | A1* | 2/2008 | Herwanger | G01V 1/30 702/18 |
| 2009/0043507 | A1 | 2/2009 | Dommisse et al. | |
| 2010/0191514 | A1 | 7/2010 | Massonnat | |
| 2010/0198638 | A1* | 8/2010 | Deffenbaugh | G01V 11/00 703/2 |
| 2010/0299117 | A1 | 11/2010 | Bjerkholt | |
| 2011/0098996 | A1 | 4/2011 | Nichols et al. | |
| 2011/0320182 | A1 | 12/2011 | Dommisse et al. | |
| 2012/0048618 | A1 | 3/2012 | Zamanian et al. | |
| 2013/0144531 | A1 | 6/2013 | Johnston | |
| 2013/0226968 | A1 | 8/2013 | Wagner et al. | |
| 2013/0338984 | A1* | 12/2013 | Braaksma | G01V 11/00 703/10 |
| 2014/0081613 | A1 | 3/2014 | Dommisse et al. | |
| 2014/0278110 | A1 | 9/2014 | Chugunov et al. | |
| 2014/0278318 | A1* | 9/2014 | Kauerauf | G01V 20/00 703/10 |
| 2015/0073715 | A1 | 3/2015 | Aarre et al. | |
| 2015/0120199 | A1 | 4/2015 | Casey | |
| 2015/0212235 | A1* | 7/2015 | Barwise | G01V 20/00 703/2 |
| 2015/0240624 | A1* | 8/2015 | Ewing | G06T 17/10 702/6 |
| 2016/0025877 | A1 | 1/2016 | Ramfjord et al. | |
| 2016/0040514 | A1 | 2/2016 | Rahmani et al. | |
| 2016/0306806 | A1 | 10/2016 | Fackler et al. | |
| 2018/0348401 | A1* | 12/2018 | Imhof | G06T 17/05 |
| 2019/0034812 | A1 | 1/2019 | Borrel et al. | |
| 2019/0203593 | A1* | 7/2019 | Fullmer | G01V 20/00 |
| 2019/0383965 | A1 | 12/2019 | Salman et al. | |
| 2020/0200929 | A1 | 6/2020 | Sepehrnoori et al. | |
| 2020/0242286 | A1 | 7/2020 | Marchidan et al. | |
| 2021/0102457 | A1 | 4/2021 | Dupont et al. | |
| 2021/0189840 | A1 | 6/2021 | Albinali | |
| 2022/0099854 | A1 | 3/2022 | Stewart | |
| 2022/0235654 | A1 | 7/2022 | Stewart | |
| 2022/0244415 | A1 | 8/2022 | Stewart | |
| 2022/0307369 | A1 | 9/2022 | Stewart | |
| 2022/0373702 | A1 | 11/2022 | Stewart | |
| 2022/0381136 | A1 | 12/2022 | Stewart | |
| 2023/0087878 | A1 | 3/2023 | Stewart | |
| 2023/0127237 | A1 | 4/2023 | Stewart | |
| 2023/0175355 | A1 | 6/2023 | Stewart | |
| 2023/0306679 | A1 | 9/2023 | Stewart | |
| 2024/0093597 | A1 | 3/2024 | Stewart | |

FOREIGN PATENT DOCUMENTS

| | | |
|---|---|---|
| WO | WO 2005051069 | 6/2005 |
| WO | WO 2009055152 | 4/2009 |
| WO | WO 2010129247 | 11/2010 |
| WO | WO 2013119245 | 8/2013 |
| WO | WO 2016144842 | 9/2016 |
| WO | WO 2019243857 | 12/2019 |

OTHER PUBLICATIONS

Lin et al., 3D geological modelling based on 2D geological map, Annals of GIS, 2017 (Year: 2017).*

Natali et al., Modeling Terrains and Subsurface Geology, Eurographics, 2013 (Year: 2013).*

Tipper et al., 3D Geological Modeling and Visualization of Rock, arXiv, 2013 (Year: 2013).*

Adams et al., "Equations of state for basin geofluids: algorithm review and intercomparison for brines," Geofluids, 2002, 2, 257-271, 15 pages.

Ahmed et al., "Brine Disposal from Inland Desalination Plants: Current Status, Problems, and Opportunities," The EnviroComp Institute, Chapter 4 of Environmental Sciences and Environmental Computing, 2004, 2, 31 pages.

Ajayi et al., "Characterization and quantification of the CO2 sequestration potential of a carbonate aquifer in Falaha Syncline, onshore Abu Dhabi," SPE-183442-MS, Abu Dhabi International Petroleum Exhibition & Conference, Abu Dhabi, UAE, Nov. 2016, 23 pages.

Al Suleimani et al., "Desalination by solar-powered reverse osmosis in a remote area of the Sultanate of Oman," Applied Energy, Apr. 2000, 65(1-4): 367-380, 14 pages.

Al-Chalabi, "Parameter nonuniqueness in velocity versus depth functions," Geophysics, 62(3), May-Jun. 1997, 970-979, 10 pages.

Al-Marhoun et al., "Black Oil Property Correlations—State of the Art," SPE-172833-MS, Society of Petroleum Engineers, 2015, 12 pages.

Aminu et al., "A review of developments in carbon dioxide storage," Applied Energy, 2017, 208: 1389-1419, 31 pages.

Archie, "The electrical resistivity log as an aid in determining some reservoir characteristics." Transactions of the AIME 146.01, Dec. 1942, 54-62, 9 pages.

Atashbari and Tingay, "Pore pressure prediction in carbonate reservoirs," SPE 150835, Society of Petroleum Engineers (SPE), presented at the SPE Latin American and Caribbean Petroleum Engineering Conference, Mexico City, Mexico, Apr. 16-18, 2012, 20 pages.

Bachu and Adams, "Sequestration of CO2 in geological media in response to climate change: capacity of deep saline aquifers to sequester CO2 in solution," Energy Conversion and Management, Dec. 2003, 44(20): 3151-3175, 25 pages.

Bachu et al., "CO2 storage capacity estimation: Methodology and gaps," International Journal of Greenhouse Gas Control, Oct. 2007, 1(4): 430-443, 14 pages.

Basile et al., "TrackDip: A multi-scale processing of dipmeter data—Method, tests, and field example for 3-D description of gravity-driven deformations in the Eocene foreland basin of Ainsa, Spain," Marine & Petroleum Geology, 2009, 26:738-751, 14 pages.

Beaumont et al., "Treatise of Petroleum Geology/Handbook of Petroleum Geology: Exploring for Oil and Gas Traps. Chapter 5: Formation Fluid Pressure and Its Application." 1999, 64 pages.

Bergbauer et al., "Improving curvature analyses of deformed horizons using scale-dependent filtering techniques" American Association of Petroleum Geologists Bulletin, 87, Aug. 2003, 1255-1272, 18 pages.

Blake, "Quantifying Depth Uncertainty", LinkedIN Pulse Article, Dec. 14, 2016, 7 pages.

Bowers, "Detecting high overpressure." The leading edge 21.2 Feb. 2002, 174-177, 4 pages.

Bradley et al., "Properties of produced waters." Petroleum Engineering Handbook, 1987, 25 pages.

Bulow, "Spherical Diffusion for 3D Surface Smoothing" IEEE Transactions on Pattern Analysis and Machine Intelligence, 26, Dec. 2004, 1650-1654, 5 pages.

(56) References Cited

OTHER PUBLICATIONS

Burton et al., "Eliminating Buoyant Migration of Sequestered CO2 Through Surface Dissolution: Implementation Costs and Technical Challenges," SPE Reservoir Evaluation & Engineering, Jun. 2009, 9 pages.
Buscheck et al., "Pre-injection brine production in CO2 storage reservoirs: An approach to augment the development, operation, and performance of CCS while generating water," International Journal of Greenhouse Gas Control, May 2016, 54: 499-512, 14 pages.
Calabrese, "Extension of Vibrating-Wire Viscometry to Electrically Conducting Fluids and Measurements of Viscosity and Density of Brines with Dissolved CO2 at Reservoir Conditions," J. Chem. Eng. Data 2019, 64, 9, 3831-3847, 17 pages.
Carmichael et al., "Method and analysis for the upscaling of structural data," Journal of Structural Geology, Feb. 2016, 83:121-133, 47 pages.
ccsnorway.com [online], "CCS Norway," Gassnova, available on or before May 16, 2020, via Internet Archive: Wayback Machine URL <http://web.archive.org/web/20200516132047/https://ccsnorway.com/>, retrieved on Nov. 23, 2021, URL <https://ccsnorway.com/>.
Celia, "Geological storage of captured carbon dioxide as a large-scale carbon mitigation option," Water Resources Research, Apr. 2017, 21 pages.
coursehero.com [online], "Automatic Dip Computation with FMI data," available on or before 2021, retrieved on Mar. 11, 2021, retrieved from URL <https://www.coursehero.com/file/p2gvqajt/Automatic-Dip-Computation-with-FMI-Data-In-Techlog-automatic-dip-computation-is/>, 22 pages.
Cronin, "Finding the Mean and 95 Percent Confidence Interval of a Set of Strike-and-Dip or Lineation Data" Environmental & Engineering Geoscience, 14, May 2008, 113-119, 7 pages.
Dataplot Reference Manual, Weighted Standard Deviation, Sep. 1996, 2 pages.
De Wardt et al., "Wellbore collision avoidance and interceptions—State of the art," SPE/IADC 163411, presented at the SPE/IADC Drilling Conference, Amsterdam, The Netherlands, Mar. 5-7, 2013, 12 pages.
Dgi.com [online], "A Statistical Approach to Depth Uncertainty Analysis for Model Integrity" Aug. 2020, [retrieved on Jul. 8, 2021], retrieved from: URL <https://www.dgi.com/blog/depth-uncertainty-analysis/>, 8 pages.
Dickey, "Increasing concentration of subsurface brines with depth." Chemical Geology 4.1-2, Mar. 1969, 361-370, 10 pages.
Difeng et al., "A new calculation approach of wellbore separation factor based on the relative position of adjacent wells," Petroleum Exploration and Development, 47(1), Feb. 2020, 196-203, 8 pages.
Duan et al., "An improved model calculating CO2 solubility in pure water and aqueous NaCl solutions from 273 to 533 K and from 0 to 2000 bar," Chemical Geology, Feb. 2003, 193(3-4): 257-271.
Etris et al., "True depth conversion: More than a pretty picture," Recorder, CSEG, Nov. 2002, 26(9):1-19, 19 pages.
Finkbeiner et al., "Stress, pore pressure, and dynamically constrained hydrocarbon columns in the South Eugene Island 330 field, northern Gulf of Mexico," American Association of Petroleum Geologists (AAPG), American Association of Petroleum Geologists Bulletin, Jun. 2001, 85(6):1007-1031, 25 pages.
Galic et al., "CO2 Injection Into Depleted Gas Reservoirs," SPE-123788-MS, Paper presented at the SPE Offshore Europe Oil and Gas Conference and Exhibition, Aberdeen, UK, Sep. 2009, 15 pages.
Garcia et al., "Density of Aqueous Solutions of CO2," OSTI Technical Report, Oct. 2001, 9 pages.
Ghenai et al., "Grid-tied and stand-alone hybrid solar power system for desalination plant," Desalination, Jun. 2018, 435: 172-180, 9 pages.
Goodman et al., "Reconciling subsurface uncertainty with the appropriate well design using the mechanical Earth model (MEM) approach," The Leading Edge, May 2007, 26(5):545-672, 4 pages.
Green et al., "The importance of recognizing hydrodynamics for understanding reservoir volumetrics, field development and well placement," presented at the Offshore Technology Conference, Houston, Texas, May 2014, 15 pages.
Hay, "Visualizing Scale-Domain Manifolds: A Multiscale Geo-Object Based Approach" In Weng, Q. (Ed.) Scale Issues in Remote Sensing. John Wiley & Sons Inc., 141-169, 31 pages.
Heinemann et al., "Hydrodynamics in subsurface CO2 storage: Tilted contacts and increased storage security," International Journal of Greenhouse Gas Control, 54:322-329, 8 pages.
Hubbert et al., "Entrapment of petroleum under hydrodynamic conditions," AAPG Bulletin, Aug. 1953, 37(8):1954-2026, 73 pages.
Jahediesfanjani et al., "Estimating the pressure-limited CO2 injection and storage capacity of the United States saline formations: Effect of the presence of hydrocarbon reservoirs," International Journal of Greenhouse Gas Control, 2018. 79: 14-24, 11 pages.
Jahediesfanjani et al., "Improving pressure-limited CO2 storage capacity in saline formations by means of brine extraction," International Journal of Greenhouse Gas Control, 2019, 88: 299-310, 12 pages.
Jin et al., "Static and Dynamic Estimates of CO2-Storage Capacity in Two Saline Formations in the UK," SPE J., Dec. 2012, 17 (04): 1108-1118, 11 pages.
Kim et al., "Partial desalination of hypersaline brine by lab-scale ion concentration polarization device," Desalination, Jun. 2017, 412: 20-31, 12 pages.
Kristoffersen et al., "An Automatic Well Planner for Efficient Well Placement Optimization under Geological Uncertainty," ECMOR XVII, Sep. 2020, 1-16, 16 pages.
Leahy et al., "Uncertainty in subsurface interpretation: a new workflow," First Break, 31, Sep. 2013, 87-93, 7 pages.
Li et al., "A method for calculating the liquid density for the CO2—H2O—NaCl system under CO2 storage condition," Energy Procedia, 2011, 4: 3817-3824, 8 pages.
Li et al., "Anomalous Pore Pressure and its Relation with In-Situ Stress Regime in Deepwater Play," SPE 145686, Society of Petroleum Engineers (SPE), presented at the SPE Annual Technical Conference and Exhibition, Denver, Colorado, Oct. 30-Nov. 2, 2011, 6 pages.
Lindeberg, "Scale Selection" In: Computer Vision, Springer, 2021, 17 pages.
Lisle et al., "The Mohr circle for curvature and its application to fold description," Journal of Structural Geology, May 1995, 17(5):739-750, 12 pages.
Ma, "An Accurate Parametric Method for Assessing Hydrocarbon Volumetrics: Revisiting the Volumetric Equation," SPE J., Jun. 2018, 23(05): 1566-1579, 14 pages.
Marler, "Survey of multi-objective optimization methods for engineering" Structural and Multidisciplinary Optimization, 26, Mar. 2004, 369-395, 27 pages.
McCann et al., "Horizontal Well Path Planning and Correction Using Optimization Techniques," Journal of Energy Resources Technology, 123, Sep. 2001, 187-193, 7 pages.
Michelioudakis et al., "Uncertainty analysis of depth predictions from seismic reflection data using Bayesian statistics," Geophysical Journal International, Mar. 2018, 213(3): 2161-2176, 34 pages.
Minar et al., "A comprehensive system of definitions of land surface (topographic) curvatures, with implications for their application in geoscience modelling and prediction," Earth-Science Reviews, Dec. 2020, 211:103414, 24 pages.
Mitasova et al., "Simultaneous Spline Approximation and Topographic Analysis for Lidar Elevation Data in Open-Source GIS" IEEE Geoscience and Remote Sensing Letters, 2, Oct. 2005, 375-379, 5 pages.
Mokhtarian et al., "A theory of multiscale, curvature-based shape representation for planar curves" IEEE Transactions on Pattern Analysis and Machine Intelligence, 14, Aug. 1992, 789-805, 17 pages.
Mynatt, "Using differential geometry to describe 3-D folds" Journal of Structural Geology, 29, Feb. 2007, 1256-1266, 11 pages.
Nasrabadi, et al., "Well placement optimization: A survey with special focus on application for gas/gas-condensate reservoirs," Journal of Natural Gas Science and Engineering, Mar. 2012, 5:6-16, 11 pages.

(56) References Cited

OTHER PUBLICATIONS

Nomeli et al., "A new model for the density of saturated solutions of CO2—H2O—NaClin saline aquifers," International Journal of Greenhouse Gas Control, Dec. 2014, 31: 192-204, 13 pages.
northernlightsccs.com [online], "Accelerating decarbonisation," Northern Lights, available on or before Oct. 11, 2021, via Internet Archive: Wayback Machine URL <http://web.archive.org/web/20211011185110/https://northernlightsccs.com/>, retrieved on Nov. 23, 2021, URL <https://northernlightsccs.com/>.
Omar et al., "Pathways for integrated concentrated solar power—Desalination: A critical review," Renewable and Sustainable Energy Reviews, Mar. 2020, 119: 109609, 17 pages.
Osborne et al., "Mechanisms for generating overpressure in sedimentary basins: a reevaluation," American Association of Petroleum Geologists Bulletin, 1997, 81:1023-1041, 19 pages.
Pau et al., "High-resolution simulation and characterization of density-driven flow in CO2 storage in saline aquifers," Advances in Water Resources, Apr. 2010, 33: 443-455.
Pool et al., "Dynamics and design of systems for geological storage of dissolved CO2," Advances in Water Resources, Dec. 2013, 62 Part C: 533-542, 10 pages.
Powley, "Pressures and hydrogeology in petroleum basins." Earth-Science Reviews 29.1-4, Oct. 1990, 215-226, 12 pages.
Rachmawati, "Critical depth uncertainty analysis for accurate well planning at Tangguh" Proceedings, Indonesian Petroleum Association, IPA17-386-G, May 2017, 11 pages.
Rose, "Risk analysis and management of petroleum exploration ventures," AAPG Methods in Exploration Series, 12, AAPG, Tulsa, Oklahoma, 2001, 164, 164 pages.
Rosin, "Determining local natural scales of curves" Pattern Recognition Letters, 19, 1998, 63-75, 13 pages.
Rudolph et al., "Benchmarking exploration predictions and performance using 20+ yr of drilling results: One company's experience," AAPG Bulletin, Feb. 2017, 101 (2): 161-176, 16 pages.
Saika et al., "3D A proposed methodology of 3D geomodeling while geosteering for optimum horizontal well placement and enhanced geological risk management," Indian Journal of Marine Geosciences, 2018, 47(4):826-830, 5 pages.
Schlumberger, "Techlog Help pages: Processing for dip variables," 2018, 3 pages.
Schulze-Riegert, et al., "Well Path Design Optimization Under Geological Uncertainty: Application to a Complex North Sea Field," SPE Russian Oil & Gas Technical Conference and Exhibition, Oct. 2010, 11 pages.
Sensia "OFM Brochure: Well and Reservoir Analysis Software" Intelligent Action, 2021, 3 pages.
Shariatipour et al., "An engineering solution for CO2 injection in saline aquifers," International Journal of Greenhouse Gas Control, Aug. 2016, 53: 98-105.
Shepherd, "Oil Field Production Geology: Volumetrics, in M. Shepherd, Oil field production geology: AAPG Memoir" AAPG, 2009, 91: 189-193, 5 pages.
Sigfusson et al., "Solving the carbon-dioxide buoyancy challenge: The design and field testing of a dissolved CO2 injection system," International Journal of Greenhouse Gas Control, Jun. 2015, 37: 213-219, 7 pages.
Squire et al., "probGRV: a workflow for geostatistical depth conversion and probabilistic assessment of gross rock volume," APPEA Journal, 2014, 54, 91-106, 16 pages.
Stamm et al., "Actors, actions, and uncertainties: optimizing decision-making based on 3-D structural geological models" Solid Earth, v. 10, Mar. 2019, 2015-2043, 29 pages.
Steele-MacInnis et al., "Volumetrics of CO2 Storage in Deep Saline Formations," Environ. Sci. Technol., 2013, 47, 1, 79-86, 8 pages.
Stewart et al., "Generalization and multiscale structure of subsurface structural maps," Interpretation, 2018, 6:T1045-T1054, 10 pages.
Stewart, "Scale dependence of strike and dip in sedimentary basins: Implications for field measurements and integrating subsurface datasets," Journal of Structural Geology, Feb. 2020, 131:103943, 21 pages.
Stewart, et al., "Multiscale structure in sedimentary basins" Basin Research, 16, 2005, 183-197, 15 pages.
Suppe, "Fluid overpressures and strength of the sedimentary upper crust," Journal of Structural Geology, 69(B), Dec. 2014, 481-492, 12 pages.
Suter et al., "Novel principles for effective Earth model grid management while geosteering," University of Stavanger, Faculty of Science and Technology, Department of Energy Resources, Sep. 2018, 170 pages.
Tacher et al., "Geological uncertainties associated with 3-D subsurface models," Computers & Geosciences, 2006, 32:212-221, 10 pages.
Thompson et al., "Designing and validating 2D reservoir models," SPE-188066-MS, presented at the SPE Kingdom of Saudi Arabia Annual Technical Symposium and Exhibition, Dammam, Saudi Arabia, Apr. 24-27, 2017, 13 pages.
Thore et al., "Structural uncertainties: Determination, management, and applications" Geophysics, v. 67, May-Jun. 2002, 840-852, 13 pages.
Totake et al., "Structural validation as an input into seismic depth conversion to decrease assigned structural uncertainty," Journal of Structural Geology, 95, 2017, 32-47, 16 pages.
Traugott, "Pore/fracture pressure determinations in deep water," Deepwater Technology, Supplement to World Oil, 218(8), 1997, 8 pages.
Trieb et al., "Concentrating solar power for seawater desalination in the Middle East and North Africa," Desalination, Presented at the conference on Desalination and the Environment. Sponsored by the European Desalination Society and Center for Research and Technology Hellas (CERTH), Sani Resort, Halkidiki, Greece, Apr. 22-25, 2007, 220(1-3): 165-183, 19 pages.
Unger, "Detangling geologic imprints on depth uncertainty: A method for analysing overburden effects on depth prediction" The Leading Edge, May 2010, 552-558, 6 pages.
Unser, "Sampling—50 Years After Shannon" Proceedings of the IEEE, 88, Apr. 2000, 569-587, 19 pages.
Wang et al., "Optimal well placement under uncertainty using a retrospective optimization framework," SPE Journal, Mar. 2012, 112-121, 10 pages.
Wellmann & Caumon, "3-D Structural Geological Models: Concepts, Methods, and Uncertainties" Advances in Geophysics, v. 59, Aug. 2019, 95 pages.
Wellmann et al., "Validating 3-D structural models with geological knowledge for improved uncertainty evaluations," Energy Procedia, 59, 2014, 374-381, 8 pages.
Wendebourg et al., "Hydrodynamics and hydrocarbon trapping: Concepts, pitfalls and insights from case studies," Marine and Petroleum Geology, 2018, 96:190-201, 12 pages.
Worthington, "Net Pay—What Is It? What Does It Do? How Do We Quantify It? How Do We Use It?," SPE Res Eval & Eng, Oct. 2010, 13 (05): 812-822, 11 pages.
Yan et al., "Measurement and modeling of CO2 solubility in NaCl brine and CO2-saturated NaCl brine density," International Journal of Greenhouse Gas Control, Nov. 2011, 5(6): 1460-1477, 18 pages.
Yang et al., "Equation for defining hydrodynamic oil-water contact surface and an alternative approach, "structure surface transformation" for mapping hydrodynamic traps," Marine and Petroleum Geology, 78:701-711, 11 pages.
Yardley and Swarbrick, "Lateral transfer: a source of additional overpressure?" Marine and Petroleum Geology, Apr. 1, 2000, 17(4):523-537, 15 pages.
Zhang et al., "Real-time pore pressure detection: indicators and improved methods." Geofluids, Jan. 2017, 12 pages.
Zhang, "Effective stress, porosity, velocity and abnormal pore pressure prediction accounting for compaction disequilibrium and unloading," Marine and Petroleum Geology, Aug. 2013, 45:2-11, 10 pages.

(56) References Cited

OTHER PUBLICATIONS

Zhang, "Pore pressure prediction from well logs: Methods, modifications, and new approaches." Earth-Science Reviews 108.1-2, Sep. 2011, 33 pages.
Zulauf, et al., "Quantification of the geometrical parameters of non-cylindrical folds" Journal of Structural Geology, 100, Jun. 2017, 120-129, 10 pages.

* cited by examiner

100 datum

1. Prepare map in computer mapping app from various inputs e.g. reflection seismic interpretation and drilled wells

| Top | Base | Area/km | Slice Volume(m^3) | Total vol above |
|---|---|---|---|---|
| -7151 | -7152 | 0 | 0 | 0 |
| -7152 | -7153 | 0.25 | 1,302.70 | 1,302.70 |
| -7153 | -7154 | 0.75 | 162,394.90 | 163,697.60 |
| -7154 | -7155 | 1 | 248,120.70 | 411,818.20 |
| -7155 | -7156 | 1 | 304,800.00 | 716,618.20 |
| -7156 | -7157 | 1.25 | 321,659.60 | 1,038,277.90 |
| -7157 | -7158 | 2 | 484,590.50 | 1,522,868.30 |
| -7158 | -7159 | 2.5 | 709,002.00 | 2,231,870.40 |
| -7159 | -7160 | 2.75 | 782,089.30 | 3,013,959.70 |
| -7160 | -7161 | 3.25 | 904,749.30 | 3,918,709.10 |
| -7161 | -7162 | 3.5 | 1,024,054.50 | 4,942,763.60 |
| -7162 | -7163 | 4 | 1,102,132.10 | 6,044,895.60 |
| -7163 | -7164 | 4 | 1,129,200.00 | 7,264,095.60 |
| -7164 | -7165 | 4.5 | 1,304,137.00 | 8,568,232.60 |
| -7165 | -7166 | 5 | 1,512,451.70 | 10,080,684.30 |
| -7166 | -7167 | 5.25 | 1,569,307.70 | 11,649,992.00 |
| -7167 | -7168 | 6 | 1,690,796.20 | 13,340,788.20 |
| -7168 | -7169 | 6.5 | 1,951,022.80 | 15,291,810.90 |
| -7169 | -7170 | 6.75 | 1,987,058.30 | 17,278,869.30 |
| -7170 | -7171 | 8 | 2,328,710.80 | 19,607,580.00 |
| -7171 | -7172 | 8.5 | 2,536,581.10 | 22,144,161.10 |
| -7172 | -7173 | 9.5 | 2,769,325.80 | 24,193,486.90 |
| -7173 | -7174 | 9.75 | 2,906,857.70 | 27,820,344.60 |
| -7174 | -7175 | 9.75 | 2,971,800.00 | 30,379,144.60 |
| -7175 | -7176 | 10.25 | 3,046,911.90 | 33,839,056.50 |
| -7176 | -7177 | 10.75 | 3,183,015,60 | 37,022,072.00 |
| -7177 | -7178 | 12 | 3,519,644.80 | 40,541,716.90 |
| -7178 | -7179 | 12.5 | 3,751,348.90 | 44,293,065.70 |
| -7179 | -7180 | 13.75 | 3,993,514.70 | 48,286,580.50 |
| -7180 | -7181 | 14 | 4,224,455.70 | 52,511,036.20 |
| -7181 | -7182 | 15.25 | 4,513,374.90 | 57,024,411.10 |
| -7182 | -7183 | 16 | 4,850,990.60 | 61,875,401.70 |

2. Run volumes in computer app and export as volume-depth array

200

PARAMETRIC ATTRIBUTE OF PORE VOLUME OF SUBSURFACE STRUCTURE FROM STRUCTURAL DEPTH MAP

TECHNICAL FIELD

The present disclosure relates to computer-implemented methods, media, and systems for parametric attribute of pore volume of subsurface structure from structural depth map.

BACKGROUND

Determining pore volume of subsurface structures at a site is part of workflows for prospects utilizing subsurface fluids or pore space in order to quantify the size of the site. Pore volume determination can be used for understanding the available oil or gas fluid that may be produced, or the potential storage or sequestration space for a fluid such as $CO_2$. If there are a number of stacked reservoirs at the site volumetrics may be repeated for each reservoir. This repeated process can lead to high computational cost even when the objective of pore volume determination is simply to rank how one site compares with another site in terms of size as opposed to formally quantifying the subsurface resource.

SUMMARY

The present disclosure involves computer-implemented methods, media, and systems for parametric attribute of pore volume of subsurface structure from structural depth map. One example computer-implemented method includes receiving multiple data points corresponding to a first reservoir unit at a site, where the site is for hydrocarbon exploration or $CO_2$ sequestration, each data point includes two elements, one of the two elements represents a depth of a respective location on a structure depth map of the first reservoir unit, and another of the two elements represents a volume that is enclosed by the structure depth map and that is between the respective location on the structure depth map of the first reservoir unit and a closing contour of the first reservoir unit. A function is curve fit to the multiple data points, where the function represents a functional relationship between a gross rock volume (GRV) of a reservoir unit at the site and a closure height of the reservoir unit, the closure height of the reservoir unit is a height from a crest of the reservoir unit to a closing contour of the reservoir unit, the crest of the reservoir unit is the shallowest point of the reservoir unit, and the GRV of the reservoir unit is truncated at the closing contour of the reservoir unit. A respective GRV of each of multiple reservoir units at the site is determined using the function. A total GRV of the multiple reservoir units at the site is determined to be the sum of the determined respective GRV of each of the multiple reservoir units. The determined total GRV of the multiple reservoir units at the site is provided for hydrocarbon prospect screening of the site or $CO_2$ sequestration screening of the site.

While generally described as computer-implemented software embodied on tangible media that processes and transforms the respective data, some or all of the aspects may be computer-implemented methods or further included in respective systems or other devices for performing this described functionality. The details of these and other aspects and implementations of the present disclosure are set forth in the accompanying drawings and the description below. Other features, objects, and advantages of the disclosure will be apparent from the description and drawings, and from the claims.

BRIEF DESCRIPTION OF DRAWINGS

Like reference numbers and designations in the various drawings indicate like elements.

DETAILED DESCRIPTION

A parametric relationship between subsurface structural shape as defined by a structural depth map and volume enclosed by the structural depth map can be used to simplify the process of determining volume of a number of stacked hydrocarbon reservoirs at a site for hydrocarbon exploration or $CO_2$ sequestration. The subsurface structure can include rocks that have pores that contain hydrocarbons. In some implementations, the subsurface structure can relate to the geometry or shape of layers in a sedimentary basis. These layers can be reservoirs or seals and can be stacked. They can be flat, inclined, or deformed into various shapes that can be characterized as structural highs and lows. Such highs and lows form traps for positively and negatively buoyant fluids in sealed reservoirs. Such highs, for example, anticlines, are relevant to positively buoyant fluids such as oil, gas and pure $CO_2$. This parametric relationship can be applied in a loop to account for all reservoir units at the site, yielding pore volume estimates that are tied to as many reservoir units as the site may contain, thereby providing a quick volume estimate that can handle a large number of reservoir units at the site. A reservoir unit can be a mappable portion of a subsurface structure within which geological and petrophysical properties that affect the flow of fluids are consistent and predictably different from the properties of other rock volumes in the subsurface structure.

This disclosure describes technologies related to determining a total gross rock volume (GRV) of multiple hydrocarbon reservoir units at a site using a structure depth map. The GRV is the volume of rock between a top and base reservoir surface and above a known or postulated hydrocarbon-water contact in a geological trap. A geological trap is a structure that allows the accumulation of hydrocarbons in a reservoir. It can include a configuration of rocks suitable for containing hydrocarbons and sealed by an impermeable formation through which hydrocarbons will not migrate. Simple traps are structural highs whose trapping volume is defined by a lowest (or deepest) closing contour (LCC). The GRV can be used to determine the magnitude of pore volumes contained, or potentially contained in the geological trap by applying porosity of the geological trap, and therefore is a parameter that can be used for hydrocarbon prospect screening or $CO_2$ sequestration screening of a site.

The total GRV can be converted to a pore volume based on porosity of each reservoir unit. Further parameters can be applied to GRV to accurately describe fluid volumes, such as net to gross reservoir as defined by various cutoffs, and fluid saturation. In some implementations, a single deterministic volume calculation can be parameterized so that it can be reused for multiple reservoirs in a given structure for which a structural depth map is relevant.

Figure 1:
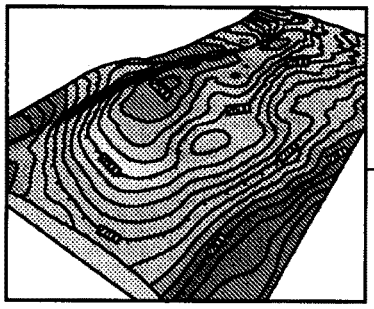
FIG. 1 illustrates an example workflow for estimating a total gross rock volume (GRV) of multiple reservoirs at a site using a structural depth map.
Figure 1:
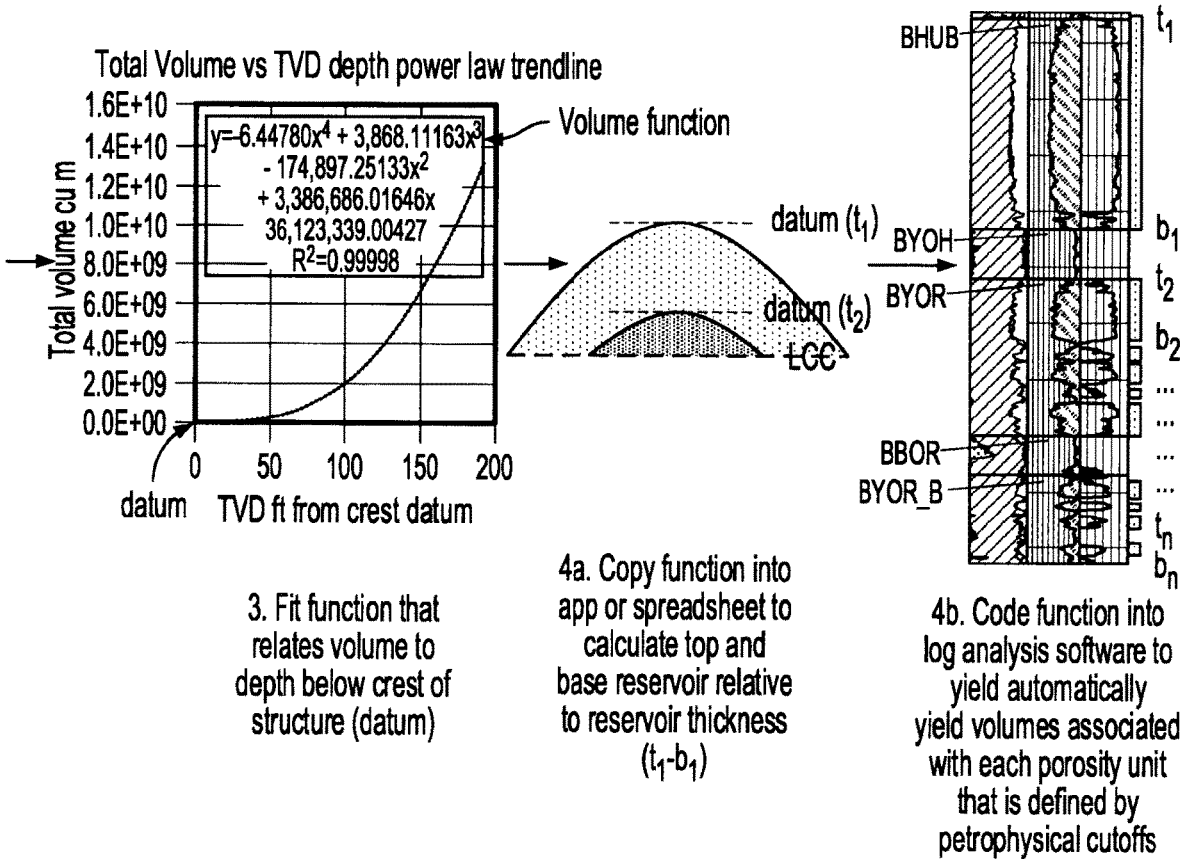

FIG. 1 illustrates an example workflow 100 for estimating the total gross rock volume of multiple reservoirs at a site using a structural depth map.

Figure 2:
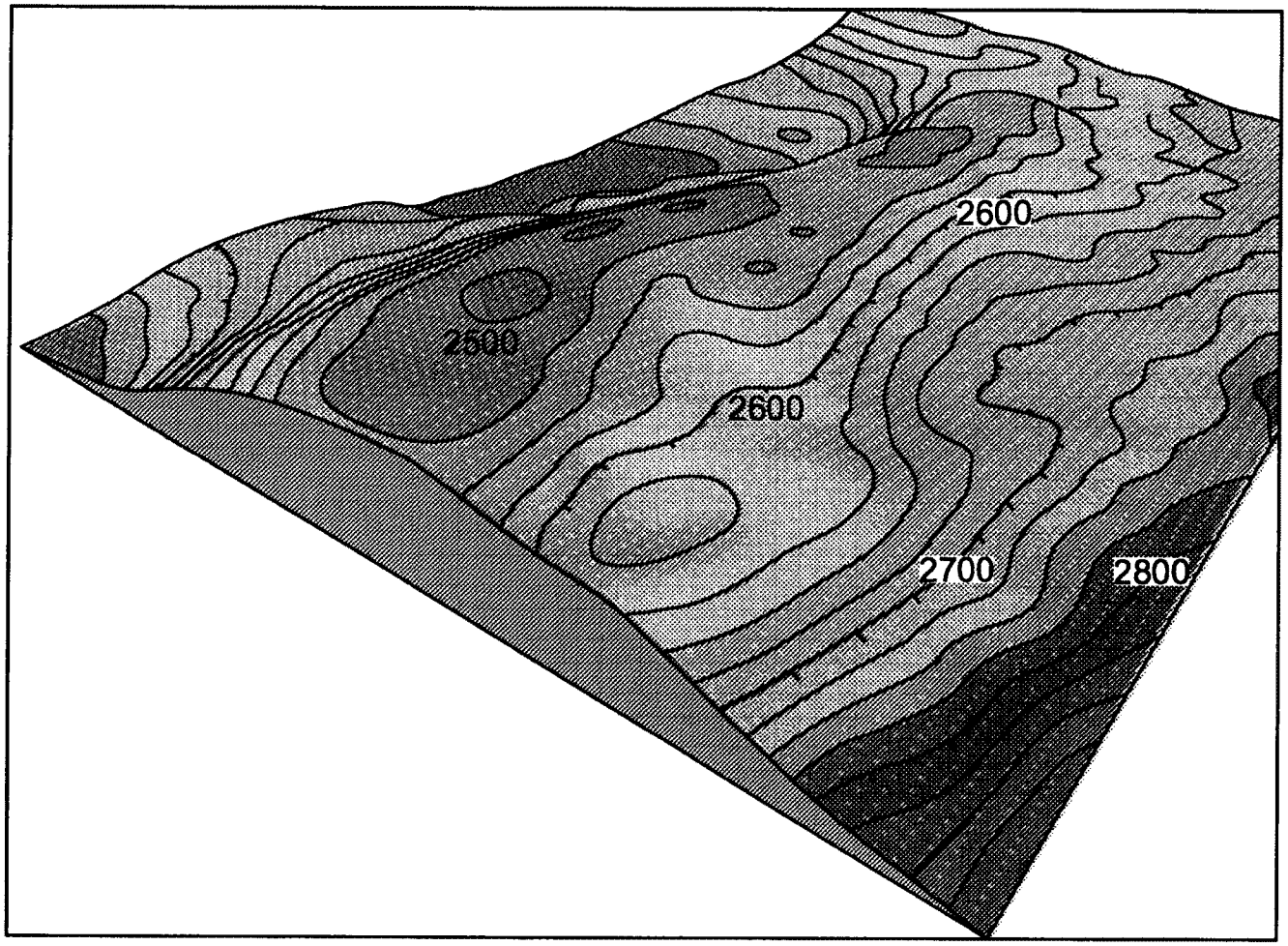
FIG. 2 illustrates an example of a continuous 3D structural depth map of a site.

In step 1, a structural depth map of the site with one or more reservoirs is created, for example, from reflection seismic interpretation or drilled wells. Seismic Interpretation is the extraction of subsurface geologic information from reflection seismic data. In some implementations, the structural depth map of the site can be created using a mapping software application. The created map can be spatially gridded to yield a continuous 3D structural depth map of the site. FIG. 2 illustrates an example 200 of a continuous 3D structural depth map of a site. The map is shaded according to depth and it shows oblique view of one subsurface reservoir. The depth can be a true vertical depth (TVD) of a location on the map. The internal volume of a reservoir may be depth limited by an imposed horizontal structural limit datum called a spill point or lowest closing contour (LCC). The LCC can be the structurally lowest point in a geological trap that can retain hydrocarbons or any other fluid that is positively buoyant relative to the pore waters that otherwise occupy the reservoir pore space.

In step 2, volume can be calculated from the structural depth map using a mapping application. This yields a single volume known as gross rock volume in a zone defined by an upper limit at top reservoir of the site, and the zone can have a lower limit in depth at a deeper datum corresponding to the limit of a single trapping structure. This lower limit in depth is the LCC of the zone. As shown in the figure of step 2 of FIG. 1, volume information can be organized in the form of a numerical array containing depths and volumes that correspond to each depth.

In step 3, the volumes generated in step 2 can be charted as a function of depth, where depth is redatumed to the shallowest structural depth, i.e., the structural crest. A trendline can be fitted to the volume-depth relationship, for instance a third or fourth order polynomial. R-squared values of 0.999 or better can be obtained in this procedure and can be optimized by varying the order of polynomial. For example, in the case of a fourth-order polynomial, the parametric expression of the trendline can be of the following form:

$$\text{Volume}=ah^4+bh^3+ch^2+dh+e \tag{1}$$

where a, b, c, d and e are the polynomial coefficients resulting from the trendline fit, and h is the depth below structural crest at which to truncate the volume. For example, the difference between the depth to structural crest and the depth to LCC can be expressed as:

$$h=t=LCC-\text{structural crest} \tag{2}$$

Figure 3:
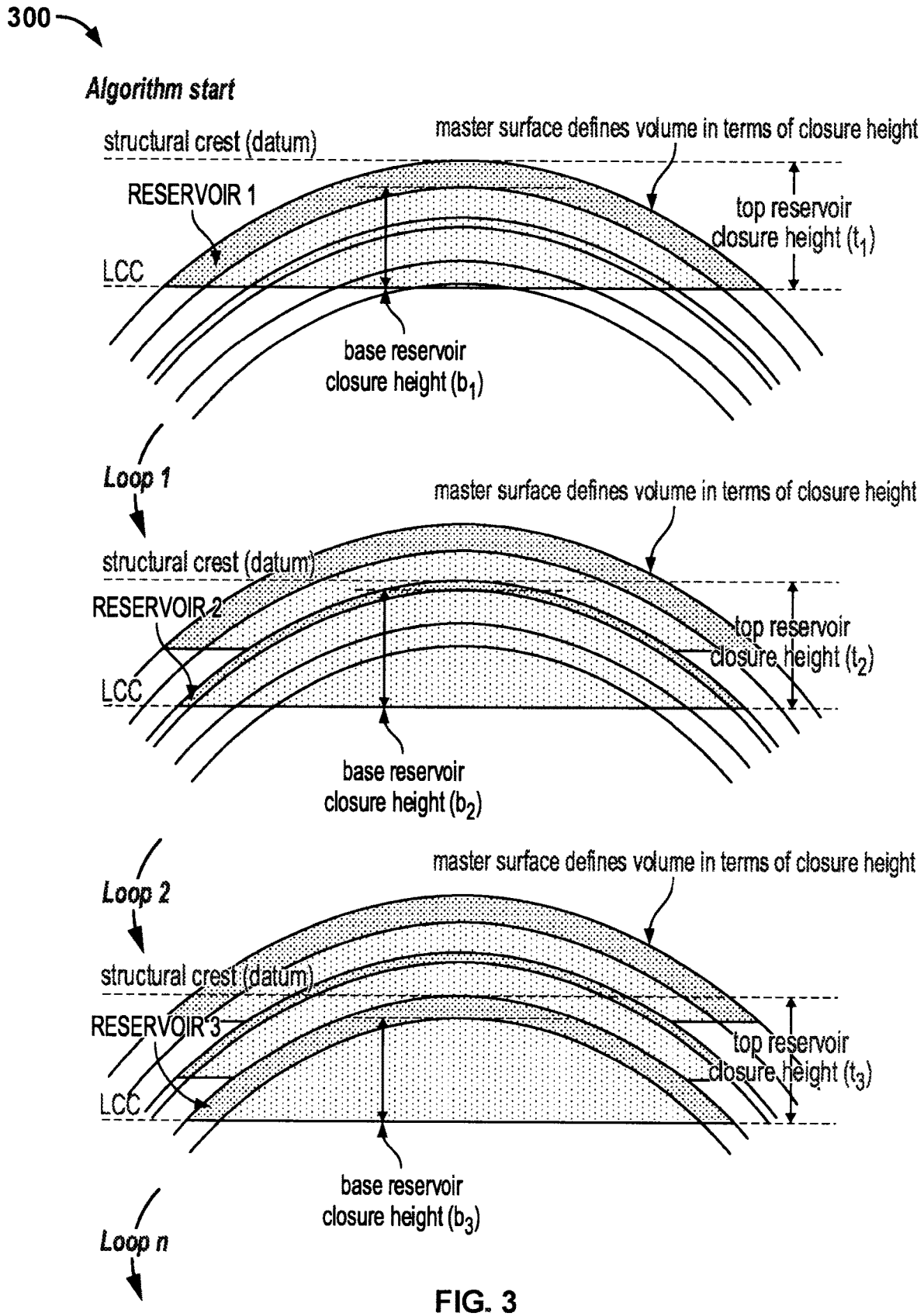
FIG. 3 illustrates an example of applying a trendline fit in a looping process to calculate a total gross rock volume of multiple reservoir units at a site.

An example 300 of applying the trendline fit in a looping process to calculate the total gross rock volume of multiple reservoir units at the site is illustrated in FIG. 3. FIG. 3 shows a site with multiple reservoir units, e.g., reservoirs 1, 2, and 3.

In some implementations, to obtain the volume of a single reservoir unit, for example, reservoir 1, 2, or 3 in FIG. 3, Equation (1) can be run two times.

First, it can be run with h set to the elevation difference between the structural crest and the LCC such that h has the value $t_1$, the top reservoir closure height for reservoir 1.

Second, a new value of h is derived to yield the volume defined by the base of the reservoir above the LCC. This value of his $b_1$. Inserting $t_1$ and $b_1$ into Equation (1) yields volumes for top and base reservoir respectively, above the LCC. Subtracting those volumes from one another yields the reservoir volume above the LCC which is the desired result for the first reservoir unit, reservoir 1, shown in FIG. 3. This procedure is then repeated for the remaining number of reservoir units, for example, reservoir 2, reservoir 3, and so on.

Several advantages of using the trendline fit to calculate the total gross rock volume of multiple reservoir units at the site are described below.

First, a single expression, e.g., Equation (1) can be derived from a representative surface at a site. This equation can be applied to all isopachous surfaces at the site, i.e., surfaces that are parallel in 3D to this representative surface. Isopachous surfaces can be found in sites with reservoir stacks.

Second, the top reservoir volume related to $h=t_1$ can be constant for all isopachous reservoir units and does not need to be recalculated.

Third, absolute depths to top and base of each reservoir unit are not needed. Using thickness alone of a given reservoir unit, for example reservoir n in FIG. 3, where thickness $z_n$ can be given by Equation (3) below:

$$z_n=b_n-t_n \tag{3}$$

where $b_n$ is the base reservoir closure height of reservoir n, and $t_n$ is the top reservoir closure height of reservoir n. In some implementations, thickness $z_n$ can be a true stratigraphic thickness (TST) that is the thickness of reservoir n measured in the direction perpendicular to the bedding planes of reservoir n.

It follows that $b_n$ can be obtained as a function of measured reservoir thickness $z_n$ and known closure height from crest to LCC $t_n$, as shown in Equation (4) below:

$$b_n=t_n+z_n \tag{4}$$

If $t_n$ is a constant, an array of $b_n$ values can be generated from a set of $z_n$ reservoir thicknesses, and the $b_n$ values can be inserted as the variable h in Equation (1). Petrophysical analysis of well logs can yield reservoir thicknesses $z_n$ based on user-specified petrophysical cutoffs. These reservoir thicknesses can be output from a petrophysical application in an array where each reservoir thickness is in turn translated into a corresponding volume using Equation (1). The sum of these volumes is the volume of all reservoirs in a structure. This process is further described in step **4*b* of workflow 100** later.

A number of loops can be made based on the number of reservoir units, and the results are summed to give total gross rock volume. The total GRV can be converted to pore volume by applying porosity values if they are available, as well as any additional multipliers that account for reservoir quality, such as net to gross parameter. Net to gross parameter represents the fraction of reservoir volume occupied by hydrocarbon-bearing rocks in a reservoir unit.

This example 300 using the volume to reservoir thickness function, i.e., Equation (1), can be used in different applications, for example, in steps **4*a* and 4*b* of workflow 100 in FIG. 1**.

In step **4*a* of workflow 100, example 300** can be implemented in a spreadsheet or a specific application, and used to convert a list of reservoir units at a site to pore volume using only the reservoir thickness, net to gross parameter, and porosity of each reservoir unit.

In a spreadsheet application a function can be propagated across many reservoir units by the construction of a table.

In step 4*b* of workflow 100, the volume to reservoir thickness function, i.e., Equation (1), can be read into a petrophysical software application or a standalone application that took the volume to reservoir thickness function and the reservoir thickness as inputs. Within a petrophysical software application, the volume to reservoir thickness function can operate on top and base reservoir units that are detected by porosity cutoffs or other criteria selected by a user. Porosity cutoffs can occur according to user-specified cutoffs such as the amount of shale determined by gamma ray log. Volume within each reservoir unit is generated via the volume to reservoir thickness function, incorporating if desired the log-based net to gross parameter and porosity of each reservoir unit that the petrophysical software application calculates. For example, the volume to reservoir thickness function can be incorporated into the petrophysical software application by updating the code inside the petrophysical software application to use the top and base of the pay zones that are defined by log cutoffs in the petrophysical software application, to use the depths corresponding to the top and base of each pay zone as inputs into the volume to reservoir thickness function. In the petrophysical software application, the gross rock volume yielded by the volume to reservoir thickness function can be modified according to the petrophysically calculated porosity and net to gross parameter in each reservoir unit, directly yielding a pore volume for each reservoir unit.

Figure 4:
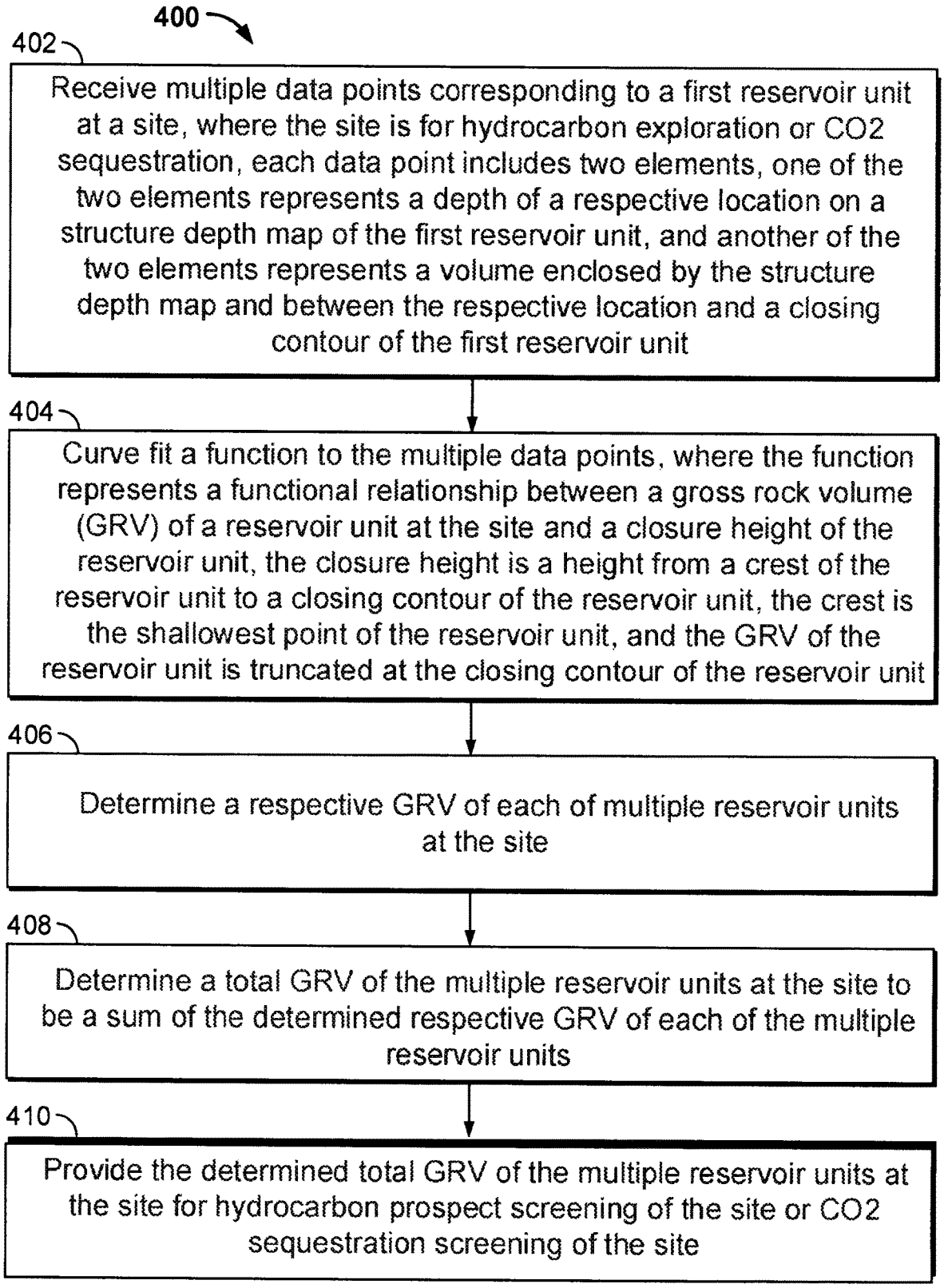
FIG. 4 illustrates an example method for determining a total gross rock volume of multiple reservoir units at a site using a structure depth map.

FIG. 4 illustrates an example method 400 for determining a total gross rock volume of multiple reservoir units at a site using a structure depth map. For convenience, the method 400 will be described as being performed by a system of one or more computers, located in one or more locations, and programmed appropriately in accordance with this specification.

At 402, a computer system receives multiple data points corresponding to a first reservoir unit at a site, where the site is for hydrocarbon exploration or CO2 sequestration, each data point includes two elements, one of the two elements represents a depth of a respective location on a structure depth map of the first reservoir unit, and another of the two elements represents a volume that is enclosed by the structure depth map and that is between the respective location on the structure depth map of the first reservoir unit and a closing contour of the first reservoir unit.

At 404, the computer system curve fits a function to the multiple data points, where the function represents a functional relationship between a gross rock volume (GRV) of a reservoir unit at the site and a closure height of the reservoir unit, the closure height of the reservoir unit is a height from a crest of the reservoir unit to a closing contour of the reservoir unit, the crest of the reservoir unit is the shallowest point of the reservoir unit, and the GRV of the reservoir unit is truncated at the closing contour of the reservoir unit.

At 406, the computer system determines a respective GRV of each of multiple reservoir units at the site using the function.

At 408, the computer system determines a total GRV of the multiple reservoir units at the site to be a sum of the determined respective GRV of each of the multiple reservoir units.

At 410, the computer system provides the determined total GRV of the multiple reservoir units at the site for hydrocarbon prospect screening of the site or $CO_2$ sequestration screening of the site.

Figure 5:
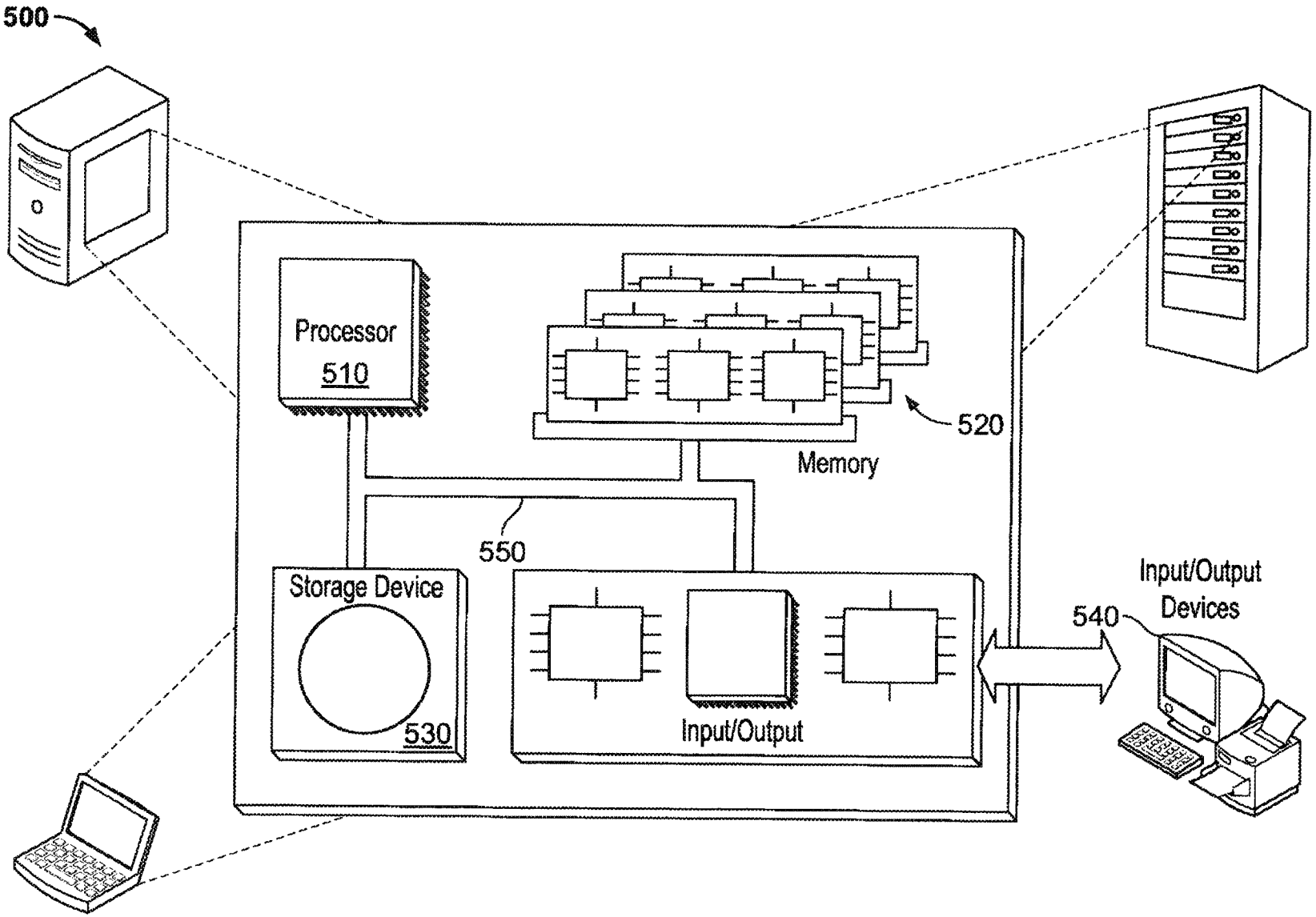
FIG. 5 is a schematic illustration of example computer systems that can be used to execute implementations of the present disclosure.

FIG. 5 illustrates a schematic diagram of an example computing system 500. The system 500 can be used for the operations described in association with the implementations described herein. For example, the system 500 may be included in any or all of the server components discussed herein. The system 500 includes a processor 510, a memory 520, a storage device 530, and an input/output device 540. The components 510, 520, 530, and 540 are interconnected using a system bus 550. The processor 510 is capable of processing instructions for execution within the system 500. In some implementations, the processor 510 is a single-threaded processor. The processor 510 is a multi-threaded processor. The processor 510 is capable of processing instructions stored in the memory 520 or on the storage device 530 to display graphical information for a user interface on the input/output device 540.

The memory 520 stores information within the system 500. In some implementations, the memory 520 is a computer-readable medium. The memory 520 is a volatile memory unit. The memory 520 is a non-volatile memory unit. The storage device 530 is capable of providing mass storage for the system 500. The storage device 530 is a computer-readable medium. The storage device 530 may be a floppy disk device, a hard disk device, an optical disk device, or a tape device. The input/output device 540 provides input/output operations for the system 500. The input/output device 540 includes a keyboard and/or pointing device. The input/output device 540 includes a display unit for displaying graphical user interfaces.

Certain aspects of the subject matter described here can be implemented as a method. Multiple data points corresponding to a first reservoir unit at a site are received, where the site is for hydrocarbon exploration or CO2 sequestration, each data point includes two elements, one of the two elements represents a depth of a respective location on a structure depth map of the first reservoir unit, and another of the two elements represents a volume that is enclosed by the structure depth map and that is between the respective location on the structure depth map of the first reservoir unit and a closing contour of the first reservoir unit. A function is curve fit to the multiple data points, where the function represents a functional relationship between a gross rock volume (GRV) of a reservoir unit at the site and a closure height of the reservoir unit, the closure height of the reservoir unit is a height from a crest of the reservoir unit to a closing contour of the reservoir unit, the crest of the reservoir unit is the shallowest point of the reservoir unit, and the GRV of the reservoir unit is truncated at the closing contour of the reservoir unit. A respective GRV of each of multiple reservoir units at the site is determined using the function. A total GRV of the multiple reservoir units at the site is determined to be a sum of the determined respective GRV of each of the multiple reservoir units. The determined total GRV of the multiple reservoir units at the site is provided for hydrocarbon prospect screening of the site or CO2 sequestration screening of the site.

An aspect taken alone or combinable with any other aspect includes the following features. Determining the respective GRV of each of the multiple reservoir units at the site using the function includes determining the respective GRV of each of the multiple reservoir units at the site using a respective thickness of each of the multiple reservoir units at the site, where the respective thickness of each of the multiple reservoir units at the site is a difference between a respective crest of each of the multiple reservoir units and a respective base of each of the multiple reservoir units.

An aspect taken alone or combinable with any other aspect includes the following features. Providing the determined total GRV of the multiple reservoir units at the site for hydrocarbon prospect screening of the site or CO2 sequestration screening of the site includes converting the determined total GRV to a pore volume of the multiple reservoir units based on respective porosity information of each of the multiple reservoir units and respective net to gross parameter information of each of the multiple reservoir units, and providing the pore volume of the multiple reservoir units at the site for hydrocarbon prospect screening of the site or CO2 sequestration screening of the site.

An aspect taken alone or combinable with any other aspect includes the following features. Determining the respective GRV of each of the multiple reservoir units at the site using the function includes determining the respective GRV of each of the multiple reservoir units at the site by implementing the function in a spreadsheet, where the function is applied to each of the multiple reservoir units using a table generated by the spreadsheet.

An aspect taken alone or combinable with any other aspect includes the following features. Determining the respective GRV of each of the multiple reservoir units at the site using the function includes determining the respective GRV of each of the multiple reservoir units at the site by implementing the function in a petrophysical software application, where the multiple reservoir units are selected from multiple pay zones generated by the petrophysical software application, and each of the multiple pay zones includes a respective reservoir unit that contains exploitable quantities of hydrocarbons.

An aspect taken alone or combinable with any other aspect includes the following features. The depth of the respective location on the structure depth map of the first reservoir unit is a true vertical depth (TVD) of the respective location on the structure depth map of the first reservoir unit.

An aspect taken alone or combinable with any other aspect includes the following features. The multiple reservoir units at the site corresponds to multiple petrophysical cutoffs from a drilled well at the site.

Certain aspects of the subject matter described in this disclosure can be implemented as a non-transitory computer-readable medium storing instructions which, when executed by a hardware-based processor perform operations including the methods described here.

Certain aspects of the subject matter described in this disclosure can be implemented as a computer-implemented system that includes one or more processors including a hardware-based processor, and a memory storage including a non-transitory computer-readable medium storing instructions which, when executed by the one or more processors performs operations including the methods described here.

Implementations and all of the functional operations described in this specification may be realized in digital electronic circuitry, or in computer software, firmware, or hardware, including the structures disclosed in this specification and their structural equivalents, or in combinations of one or more of them. Implementations may be realized as one or more computer program products (i.e., one or more modules of computer program instructions encoded on a computer readable medium for execution by, or to control the operation of, data processing apparatus). The computer readable medium may be a machine-readable storage device, a machine-readable storage substrate, a memory device, a composition of matter effecting a machine-readable propagated signal, or a combination of one or more of them. The term "computing system" encompasses all apparatus, devices, and machines for processing data, including by way of example a programmable processor, a computer, or multiple processors or computers. The apparatus may include, in addition to hardware, code that creates an execution environment for the computer program in question (e.g., code that constitutes processor firmware, a protocol stack, a database management system, an operating system, or any appropriate combination of one or more thereof). A propagated signal is an artificially generated signal (e.g., a machine-generated electrical, optical, or electromagnetic signal) that is generated to encode information for transmission to suitable receiver apparatus.

A computer program (also known as a program, software, software application, script, or code) may be written in any appropriate form of programming language, including compiled or interpreted languages, and it may be deployed in any appropriate form, including as a stand-alone program or as a module, component, subroutine, or other unit suitable for use in a computing environment. A computer program does not necessarily correspond to a file in a file system. A program may be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program may be deployed to be executed on one computer or on multiple computers that are located at one site or distributed across multiple sites and interconnected by a communication network.

The processes and logic flows described in this specification may be performed by one or more programmable processors executing one or more computer programs to perform functions by operating on input data and generating output. The processes and logic flows may also be performed by, and apparatus may also be implemented as, special purpose logic circuitry (e.g., an FPGA (field programmable gate array) or an ASIC (application specific integrated circuit)).

Processors suitable for the execution of a computer program include, by way of example, both general and special purpose microprocessors, and any one or more processors of any appropriate kind of digital computer. Generally, a processor will receive instructions and data from a read only memory or a random access memory or both. Elements of a computer can include a processor for performing instructions and one or more memory devices for storing instructions and data. Generally, a computer will also include, or be operatively coupled to receive data from or transfer data to, or both, one or more mass storage devices for storing data (e.g., magnetic, magneto optical disks, or optical disks). However, a computer need not have such devices. Moreover, a computer may be embedded in another device (e.g., a mobile telephone, a personal digital assistant (PDA), a mobile audio player, a Global Positioning System (GPS) receiver). Computer readable media suitable for storing computer program instructions and data include all forms of non-volatile memory, media and memory devices, including by way of example semiconductor memory devices (e.g., EPROM, EEPROM, and flash memory devices); magnetic disks (e.g., internal hard disks or removable disks); magneto optical disks; and CD ROM and DVD-ROM disks. The processor and the memory may be supplemented by, or incorporated in, special purpose logic circuitry.

To provide for interaction with a user, implementations may be realized on a computer having a display device (e.g., a CRT (cathode ray tube), LCD (liquid crystal display) monitor) for displaying information to the user and a keyboard and a pointing device (e.g., a mouse, a trackball, a touch-pad), by which the user may provide input to the computer. Other kinds of devices may be used to provide for interaction with a user as well; for example, feedback provided to the user may be any appropriate form of sensory feedback (e.g., visual feedback, auditory feedback, tactile feedback); and input from the user may be received in any appropriate form, including acoustic, speech, or tactile input.

Implementations may be realized in a computing system that includes a back end component (e.g., as a data server), a middleware component (e.g., an application server), and/or a front end component (e.g., a client computer having a graphical user interface or a Web browser, through which a user may interact with an implementation), or any appropriate combination of one or more such back end, middleware, or front end components. The components of the system may be interconnected by any appropriate form or medium of digital data communication (e.g., a communication network). Examples of communication networks include a local area network ("LAN") and a wide area network ("WAN"), e.g., the Internet.

The computing system may include clients and servers. A client and server are generally remote from each other and typically interact through a communication network. The relationship of client and server arises by virtue of computer programs running on the respective computers and having a client-server relationship to each other.

While this specification contains many specifics, these should not be construed as limitations on the scope of the disclosure or of what may be claimed, but rather as descriptions of features specific to particular implementations. Certain features that are described in this specification in the context of separate implementations may also be implemented in combination in a single implementation. Conversely, various features that are described in the context of a single implementation may also be implemented in multiple implementations separately or in any suitable sub-combination. Moreover, although features may be described above as acting in certain combinations and even initially claimed as such, one or more features from a claimed combination may in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems may generally be integrated together in a single software product or packaged into multiple software products.

A number of implementations have been described. Nevertheless, it will be understood that various modifications may be made without departing from the spirit and scope of the disclosure. For example, various forms of the flows shown above may be used, with steps re-ordered, added, or removed. Accordingly, other implementations are within the scope of the following claims.

What is claimed is:

1. A computer-implemented method, comprising:

receiving a plurality of data points corresponding to a first reservoir unit at a site, wherein the site is for hydrocarbon exploration or $CO_2$ sequestration, each data point comprises two elements, one of the two elements represents a depth of a respective location on a structure depth map of the first reservoir unit, and another of the two elements represents a volume that is enclosed by the structure depth map and that is between the respective location on the structure depth map of the first reservoir unit and a closing contour of the first reservoir unit;

curve fitting a function to the plurality of data points corresponding to the first reservoir unit at the site, wherein the function represents a functional relationship between a gross rock volume (GRV) of the first reservoir unit at the site and a closure height of the first reservoir unit, the closure height of the first reservoir unit is a height from a crest of the first reservoir unit to the closing contour of the first reservoir unit, the crest of the first reservoir unit is a shallowest point of the first reservoir unit that is retaining hydrocarbons or a fluid that is positively buoyant relative to water, and the GRV of the first reservoir unit is truncated at the closing contour of the first reservoir unit, the functional relationship defining a plurality of isopachous surfaces at the site;

determining a respective GRV of each of a plurality of reservoir units at the site using the function;

determining a total GRV of the plurality of reservoir units at the site to be a sum of the determined respective GRV of each of the plurality of reservoir units; and performing $CO_2$ sequestration at the site using the determined total GRV of the plurality of reservoir units at the site.

2. The computer-implemented method of claim 1, wherein determining the respective GRV of each of the plurality of reservoir units at the site using the function comprises determining the respective GRV of each of the plurality of reservoir units at the site using a respective thickness of each of the plurality of reservoir units at the site, wherein the respective thickness of each of the plurality of reservoir units at the site is a difference between a respective crest of each of the plurality of reservoir units and a respective base of each of the plurality of reservoir units.

3. The computer-implemented method of claim 1, wherein performing $CO_2$ sequestration screening of the site using the determined total GRV of the plurality of reservoir units at the site comprises:

converting the determined total GRV to a pore volume of the plurality of reservoir units based on respective porosity information of each of the plurality of reservoir units and respective net to gross parameter information of each of the plurality of reservoir units; and performing $CO_2$ sequestration screening of the site using the pore volume of the plurality of reservoir units at the site.

4. The computer-implemented method of claim 1, wherein determining the respective GRV of each of the plurality of reservoir units at the site using the function comprises determining the respective GRV of each of the plurality of reservoir units at the site by implementing the function in a spreadsheet, wherein the function is applied to each of the plurality of reservoir units using a table generated by the spreadsheet.

5. The computer-implemented method of claim 1, wherein determining the respective GRV of each of the plurality of reservoir units at the site using the function comprises determining the respective GRV of each of the plurality of reservoir units at the site by implementing the function in a petrophysical software application, wherein the plurality of reservoir units are selected from a plurality of pay zones generated by the petrophysical software application, and wherein each of the plurality of pay zones comprises a respective reservoir that contains exploitable quantities of hydrocarbons.

6. The computer-implemented method of claim 1, wherein the depth of the respective location on the structure depth map of the first reservoir unit is a true vertical depth (TVD) of the respective location on the structure depth map of the first reservoir unit.

7. The computer-implemented method of claim 1, wherein the plurality of reservoir units at the site corresponds to a plurality of petrophysical cutoffs from a drilled well at the site.

8. A non-transitory, computer-readable medium storing one or more instructions executable by a computer system to perform operations comprising:

receiving a plurality of data points corresponding to a first reservoir unit at a site, wherein the site is for hydrocarbon exploration or $CO_2$ sequestration, each data point comprises two elements, one of the two elements represents a depth of a respective location on a structure depth map of the first reservoir unit, and another of the two elements represents a volume that is enclosed by the structure depth map and that is between the respective location on the structure depth map of the first reservoir unit and a closing contour of the first reservoir unit;

curve fitting a function to the plurality of data points corresponding to the first reservoir unit at the site, wherein the function represents a functional relationship between a gross rock volume (GRV) of the first reservoir unit at the site and a closure height of the first reservoir unit, the closure height of the first reservoir unit is a height from a crest of the first reservoir unit to the closing contour of the first reservoir unit, the crest of the first reservoir unit is a shallowest point of the first reservoir unit that is retaining hydrocarbons or a fluid that is positively buoyant relative to water, and the GRV of the first reservoir unit is truncated at the closing contour of the first reservoir unit, the functional relationship defining a plurality of isopachous surfaces at the site;

determining a respective GRV of each of a plurality of reservoir units at the site using the function;

determining a total GRV of the plurality of reservoir units at the site to be a sum of the determined respective GRV of each of the plurality of reservoir units; and performing $CO_2$ sequestration at the site using the determined total GRV of the plurality of reservoir units at the site.

9. The non-transitory, computer-readable medium of claim 8, wherein determining the respective GRV of each of the plurality of reservoir units at the site using the function comprises determining the respective GRV of each of the plurality of reservoir units at the site using a respective thickness of each of the plurality of reservoir units at the site, wherein the respective thickness of each of the plurality of reservoir units at the site is a difference between a respective crest of each of the plurality of reservoir units and a respective base of each of the plurality of reservoir units.

10. The non-transitory, computer-readable medium of claim 8, wherein performing $CO_2$ sequestration screening of the site using the determined total GRV of the plurality of reservoir units at the site comprises:

converting the determined total GRV to a pore volume of the plurality of reservoir units based on respective porosity information of each of the plurality of reservoir units and respective net to gross parameter information of each of the plurality of reservoir units; and performing $CO_2$ sequestration screening of the site using the pore volume of the plurality of reservoir units at the site.

11. The non-transitory, computer-readable medium of claim 8, wherein determining the respective GRV of each of the plurality of reservoir units at the site using the function comprises determining the respective GRV of each of the plurality of reservoir units at the site by implementing the function in a spreadsheet, wherein the function is applied to each of the plurality of reservoir units using a table generated by the spreadsheet.

12. The non-transitory, computer-readable medium of claim 8, wherein determining the respective GRV of each of the plurality of reservoir units at the site using the function comprises determining the respective GRV of each of the plurality of reservoir units at the site by implementing the function in a petrophysical software application, wherein the plurality of reservoir units are selected from a plurality of pay zones generated by the petrophysical software application, and wherein each of the plurality of pay zones comprises a respective reservoir that contains exploitable quantities of hydrocarbons.

13. The non-transitory, computer-readable medium of claim 8, wherein the depth of the respective location on the structure depth map of the first reservoir unit is a true vertical depth (TVD) of the respective location on the structure depth map of the first reservoir unit.

14. The non-transitory, computer-readable medium of claim 8, wherein the plurality of reservoir units at the site corresponds to a plurality of petrophysical cutoffs from a drilled well at the site.

15. A computer-implemented system, comprising:

one or more computers; and one or more computer memory devices interoperably coupled with the one or more computers and having tangible, non-transitory, machine-readable media storing one or more instructions that, when executed by the one or more computers, perform one or more operations comprising:

receiving a plurality of data points corresponding to a first reservoir unit at a site, wherein the site is for hydrocarbon exploration or $CO_2$ sequestration, each data point comprises two elements, one of the two elements represents a depth of a respective location on a structure depth map of the first reservoir unit, and another of the two elements represents a volume that is enclosed by the structure depth map and that is between the respective location on the structure depth map of the first reservoir unit and a closing contour of the first reservoir unit;

curve fitting a function to the plurality of data points corresponding to the first reservoir unit at the site, wherein the function represents a functional relationship between a gross rock volume (GRV) of the first reservoir unit at the site and a closure height of the first reservoir unit, the closure height of the first reservoir unit is a height from a crest of the first reservoir unit to the closing contour of the first reservoir unit, the crest of the first reservoir unit is a shallowest point of the first reservoir unit that is retaining hydrocarbons or a fluid that is positively buoyant relative to water, and the GRV of the first reservoir unit is truncated at the closing contour of the first reservoir unit, the functional relationship defining a plurality of isopachous surfaces at the site;

determining a respective GRV of each of a plurality of reservoir units at the site using the function;

determining a total GRV of the plurality of reservoir units at the site to be a sum of the determined respective GRV of each of the plurality of reservoir units; and performing $CO_2$ sequestration screening of at the site using the determined total GRV of the plurality of reservoir units at the site.

16. The computer-implemented system of claim 15, wherein determining the respective GRV of each of the plurality of reservoir units at the site using the function comprises determining the respective GRV of each of the plurality of reservoir units at the site using a respective thickness of each of the plurality of reservoir units at the site, wherein the respective thickness of each of the plurality of reservoir units at the site is a difference between a respective crest of each of the plurality of reservoir units and a respective base of each of the plurality of reservoir units.

17. The computer-implemented system of claim 15, wherein performing $CO_2$ sequestration screening of the site using the determined total GRV of the plurality of reservoir units at the site comprises:

converting the determined total GRV to a pore volume of the plurality of reservoir units based on respective porosity information of each of the plurality of reservoir units and respective net to gross parameter information of each of the plurality of reservoir units; and performing $CO_2$ sequestration screening of the site using the pore volume of the plurality of reservoir units at the site.

18. The computer-implemented system of claim 15, wherein determining the respective GRV of each of the plurality of reservoir units at the site using the function comprises determining the respective GRV of each of the plurality of reservoir units at the site by implementing the function in a spreadsheet, wherein the function is applied to each of the plurality of reservoir units using a table generated by the spreadsheet.

19. The computer-implemented system of claim 15, wherein determining the respective GRV of each of the plurality of reservoir units at the site using the function comprises determining the respective GRV of each of the plurality of reservoir units at the site by implementing the function in a petrophysical software application, wherein the plurality of reservoir units are selected from a plurality of pay zones generated by the petrophysical software application, and wherein each of the plurality of pay zones comprises a respective reservoir that contains exploitable quantities of hydrocarbons.

20. The computer-implemented system of claim 15, wherein the plurality of reservoir units at the site corresponds to a plurality of petrophysical cutoffs from a drilled well at the site.

* * * * *